United States Patent [19]

Koumura et al.

[11] Patent Number: 4,513,713

[45] Date of Patent: Apr. 30, 1985

[54] METHOD OF CONTROLLING OPERATING AMOUNTS OF OPERATION CONTROL MEANS FOR AN INTERNAL COMBUSTION ENGINE

[75] Inventors: Takashi Koumura, Saitama; Toyohei Nakajima, Shiki, both of Japan

[73] Assignee: Honda Giken Kogyo Kabushiki Kaisha, Tokyo, Japan

[21] Appl. No.: 646,684

[22] Filed: Aug. 31, 1984

[30] Foreign Application Priority Data

Sep. 6, 1983 [JP] Japan ..... 58-163789
Oct. 20, 1983 [JP] Japan ..... 58-196891

[51] Int. Cl.[3] ..... F02D 31/00

[52] U.S. Cl. ..... 123/339; 123/494; 123/585

[58] Field of Search ..... 123/339, 340, 494, 478, 123/587, 585

[56] References Cited

U.S. PATENT DOCUMENTS 4,108,127 8/1978 Chapin ..... 123/339
4,237,833 12/1980 Des Lauriers ..... 123/339
4,237,838 12/1980 Kinugawa ..... 123/587

*Primary Examiner*—Ronald B. Cox
*Attorney, Agent, or Firm*—Lyon & Lyon

[57] ABSTRACT

A method of electronically controlling an operating amount of a control means for controlling operation of an internal combustion engine, such as a fuel injection control means. When the engine is operating in a predetermined low load condition, a desired operating amount of the control means is determined in dependence on the detected value of a first engine operating parameter indicative of loaded conditions of the engine, whereas when the engine is not operating in the predetermined low load condition, the desired operating amount of the control means is determined in dependence on the detected value of a second engine operating parameter indicative of loaded conditions of the engine. In addition, first and second provisional desired operating amounts of the control means are determined, respectively, in dependence on the detected values of the first and second engine operating parameters when it is detected that the engine has entered the predetermined low load condition from a condition other than the predetermined low load condition. The desired operating amount of the control means is determined in dependence on the second provisional desired operating amount from the time it is detected that the engine has entered the predetermined low load condition to the time the second provisional desired operating amount becomes substantially equal to the first provisional desired operating amount, even while the engine is actually operating in the predetermined low load condition. The control means is controlled on the basis of the desired operating amount thus determined.

11 Claims, 10 Drawing Figures

DETERMINE Ti MAP BY SD METHOD
1
Ne < NIDL ?
2
No
Yes
PBA < PBAC ?
3
No
Yes
θTH ≦ θIDLH ?
4
No
Yes
CALCULATE Tic BY KMe METHOD
7
WAS KMe METHOD APPLIED IN PRECEDING LOOP ?
8
Yes
No
TiMAP·KPA1·KTA1 ≦ CH·TiC·KPA2·KTA2 ?
9
No
Xn = 3
10
Yes
TiMAP·KPA1·KTA1 ≧ CL·TiC·KPA2·KTA2 ?
11
Xn = 2
12
Yes
|Xn-Xn-1| = 1 ?
13
Yes
No
Xn = 0
5
Ti·KPA·KTA = TiC·KPA2·KTA2
14
Ti·KPA·KTA = TiMAP·KPA1·KTA1
6
CALCULATE TOUT
15

METHOD OF CONTROLLING OPERATING AMOUNTS OF OPERATION CONTROL MEANS FOR AN INTERNAL COMBUSTION ENGINE

BACKGROUND OF THE INVENTION

This invention relates to a method of controlling the operating amount of an operation control means for an internal combustion engine, and more particularly to a method of this kind which is adapted to set a desired operating amount for an operation control means, which is optimal to an operating condition of the engine in a predetermined low region, to thereby achieve smooth operation of the engine.

A method has been proposed, e.g. by Japanese Provisional Patent Publications (Kokai) Nos. 57-137633 and 53-8434, which determines a basic operating amount of operation control means for controlling the operation of the engine, such as a basic fuel injection amount to be supplied to the engine by a fuel supply quantity control system, a basic value of ignition timing to be controlled by an ignition timing control system, and a basic recirculation amount of exhaust gases to be controlled by an exhaust gas recirculation control system, in dependence on values of engine operating parameters indicative of loaded conditions of the engine, such as absolute pressure in the intake pipe of the engine and engine rotational speed, and corrects the basic operating amount thus determined in response to the temperature of intake air, the temperature of engine cooling water, etc., to thereby set a desired operating amount for the operation control means with accuracy.

Further, it is also known to design the intake pipe of the engine, particularly a portion thereof downstream of a throttle valve therein, to have a large volume enough to increase the charging efficiency of intake air, thereby achieving improved operating characteristics of the engine, such as increased output of the engine.

However, to increase the volume of the intake pipe at a portion downstream of the throttle valve causes a reduced rate of change in the intake pipe absolute pressure relative to the lapse of time with respect to a rate of change in the engine speed relative to the lapse of time, while the engine is operating in a low load condition, such as at idle. Therefore, with the above-mentioned proposed method of determining operating amounts of the operation control means in dependence on the intake pipe absolute pressure and the engine speed (generally called "the speed density method", and hereinafter merely referred to as "the SD method"), it is difficult to set with accuracy an operating amount such as a fuel supply quantity in accordance with operating conditions of the engine, thus causing hunting of the engine rotation. In view of the foregoing, a method (hereinafter merely called "the KMe method") has been proposed, e.g. by Japanese Patent Publication No. 52-6414, which is based upon the recognition that the quantity of intake air passing the throttle valve is not dependent upon pressure PBA in the intake pipe downstream of the throttle valve or pressure of the exhaust gases while the engine is operating in a particular low load condition wherein the ratio of intake pipe pressure PA' upstream of the throttle valve to intake pipe pressure PBA downstream of the throttle valve is below a critical pressure ratio (=0.528) at which the intake air forms a sonic flow, and accordingly the quantity of intake air can be determined solely in dependence on the valve opening of the throttle valve. Therefore, this proposed method detects the valve opening of the throttle valve alone to thereby detect the quantity of intake air with accuracy while the engine is operating in the above-mentioned particular low load condition, and then sets an operating amount such as a fuel injection quantity on the basis of the detected value of the intake air quantity.

However, if, for instance, the manner of setting the fuel injection quantity is promptly switched from the SD method to the KMe method immediately when the engine enters the above particular low load condition from a condition other than the particular low load condition, an abrupt change can occur in the fuel injection quantity to even cause engine shock and engine stall.

Further, an idling rpm control method is disclosed, e.g. in U.S. Pat. Ser. No. 491,208 assigned to the assignee of the present application, which is adapted to maintain the idling speed of the engine at a constant value by controlling the quantity of supplementary air being supplied to the engine through an auxiliary air passage bypassing the throttle valve, and which is also adapted to improve the startability of the engine in a cold condition by controlling the idling speed to a higher value than a desired value for normal temperature idling operation, in such cold condition. Thus, when the intake air being supplied to the engine is formed by not only air passing the throttle valve but also supplementary air passing a control valve arranged in the auxiliary air passage bypassing the throttle valve, the total quantity of intake air being supplied to the engine cannot be detected merely through detection of the valve opening of the throttle valve alone. Therefore, it is not possible to set with accuracy the operating amount of an operation control means, such as a fuel injection quantity, by the above KMe method.

SUMMARY OF THE INVENTION

It is the object of the invention to provide a method of controlling the operating amount of an operation control means for controlling an internal combustion engine, which is adapted to set with accuracy a desired operating amount for the operation control means in response to operating conditions of the engine, such as a quantity of air actually supplied to the engine, when the engine is operating in a predetermined low load condition, thereby achieving stable and smooth operation of the engine.

According to a first embodiment of the invention, a method of electronically controlling an operating amount of an operation control means for controlling the operation of an internal combustion engine is provided, which is characterized by comprising the steps of: (1) detecting a value of a first engine operating parameter indicative of loaded conditions of the engine; (2) detecting a value of a second engine operating parameter indicative of loaded conditions of the engine; (3) determining whether or not the engine is operating in a predetermined low load condition; (4) determining a desired operating amount of the operation control means in dependence on the detected value of the first engine operating parameter obtained at the step (1) when the engine is determined to be operating in the predetermined low load condition; (5) determining the desired operating amount of the operation control means in dependence on the detected value of the second engine operating parameter obtained at the step (2) when the engine is determined not to be operating in the predetermined low load condition; (6) determining first and second provisional desired operating amounts of the operation control means, respectively, in dependence on the detected values of the first and second engine operating parameters, when it is determined that the engine has entered the predetermined low load condition from a condition other than the predetermined low load condition; (7) comparing the determined first provisional desired operating amount with the determined second provisional desired operating amount; (8) determining the desired operating amount of the operation control means in dependence on the determined second provisional desired operating amount from the time it is determined that the engine has entered the predetermined low load condition to the time the determined second provisional desired operating amount becomes substantially equal to the determined first provisional desired operating amount, even while the engine is actually operating in the predetermined low load condition; and (9) controlling the operating amount of the operation control means on the basis of the desired operating amount determined at the step (4), (5) or (8).

Preferably, the operating amount of the operation control means is controlled on the basis of the desired operating amount determined at the step (4) when the second provisional desired operating amount determined at the step (6) decreases across a value substantially equal to the first provisional desired operating amount determined at the step (6), or when the second provisional desired operating amount exceeds across a value substantially equal to the first provisional desired operating amount.

Still preferably, once the desired operating amount of the operation control means is determined in dependence on the detected value of the first engine operating parameter after it is determined that the engine has entered the predetermined low load condition, the operating amount of the operation control means is continuously or repeatedly controlled on the basis of the desired operating amount determined at the step (4) until the engine is determined to be in a condition other than the predetermined low load condition.

According to a second embodiment of the invention, a method is provided for electronically controlling the fuel supply to an internal combustion engine, wherein a required quantity of fuel is injected into the engine in synchronism with generation of pulses of a predetermined control signal indicative of predetermined crank angles of the engine. The engine has an intake pipe, a throttle valve arranged across the intake pipe, an auxiliary air passage opening in the intake pipe at a location downstream of the throttle valve and communicating with the atmosphere, and a control valve arranged in the auxiliary air passage for controlling the quantity of supplementary air being supplied to the engine through the auxiliary air passage and the intake pipe. The method is characterized by comprising the steps of: (1) detecting a value of opening area corresponding to actual valve opening of the throttle valve; (2) detecting a value of opening area corresponding to actual valve opening of the control valve; (3) detecting an interval of time between generation of a preceding pulse of the predetermined control signal and generation of a present pulse of same; (4) detecting pressure in the intake pipe downstream of the throttle valve; (5) determining whether or not the engine is operating in a predetermined low load condition; (6) determining values of first and second coefficients, respectively, in dependence on the detected value of opening area of the throttle valve obtained at the step (1) and the detected value of opening area of the control valve obtained at the step (2), when the engine is determined to be operating in the predetermined low load condition; (7) determining a desired amount of fuel to be injected into the engine in dependence on a sum of the values of the first and second coefficients obtained at the step (6) and the detected value of interval of time between generation of a preceding pulse of the predetermined control signal and generation of a present pulse of same, obtained at the step (3); (8) determining the desired amount of fuel to be injected into the engine at least in dependence on the detected value of pressure in the intake pipe obtained at the step (4) when the engine is determined not to be operating in the predetermined low load condition; (9) determining a first provisional desired fuel injection amount in dependence on the sum of the values of the first and second coefficients corresponding, respectively, to the detected value of opening area of the throttle valve and the detected value of opening area of the control valve as well as on the detected value of interval of time between generation of a preceding pulse of the predetermined control signal and generation of a present pulse of same, and a second provisional desired fuel injection amount at least in dependence on the detected value of pressure in the intake pipe, when it is determined that the engine has entered the predetermined low load condition from a condition other than the predetermined low load condition; (10) comparing the determined first provisional desired fuel injection amount with the determined second provisional desired fuel injection amount; (11) determining the desired fuel injection amount in dependence on the determined second provisional desired fuel injection amount from the time it is determined that the engine has entered the predetermined low load condition to the time the determined second provisional desired fuel injection amount becomes substantially equal to the determined first provisional desired fuel injection amount, even while the engine is actually operating in the predetermined low load condition; and (12) controlling the quantity of fuel to be injected into the engine on the basis of the desired fuel injection amount determined at the step (7), (8) or (11).

Preferably, in the above step (7), the desired fuel injection amount is determined in dependence on a product value obtained through multiplication of the sum of the determined values of the first and second coefficients by the detected value of interval of time between generation of a preceding pulse of the predetermined control signal and generation of a present pulse of same.

Also preferably, the control valve comprises an on-off type electromagnetic valve, and an opening area value corresponding to actual valve opening of the control valve is determined in response to a valve opening duty ratio of the control valve.

Still preferably, the auxiliary air passage includes a plurality of passages, and the control valve includes a plurality of valves arranged in respective ones of the passages for controlling the quantity of supplementary air being supplied to the engine through corresponding ones of the passages and the intake pipe. The second coefficient has a value thereof determined in dependence on a total sum of values of opening areas corresponding to the respective valve openings of the above valves.

Preferably, the second coefficient has a value thereof determined as a sum of coefficient values which are set in dependence on respective values of opening areas corresponding to actual valve openings of the above valves.

Still preferably, the above step (5) comprises the steps of detecting a value of pressure in the intake pipe upstream of the throttle valve, setting a reference pressure value in dependence on the detected value of pressure in the intake pipe upstream of the throttle valve, comparing the reference pressure value with the detected value of pressure in the intake pipe downstream of the throttle valve, obtained at the aforementioned step (4), and determining that the engine is operating in the predetermined low load condition when the detected value of pressure in the intake pipe downstream of the throttle valve shows a value indicative of lower engine load with respect to the reference pressure value.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
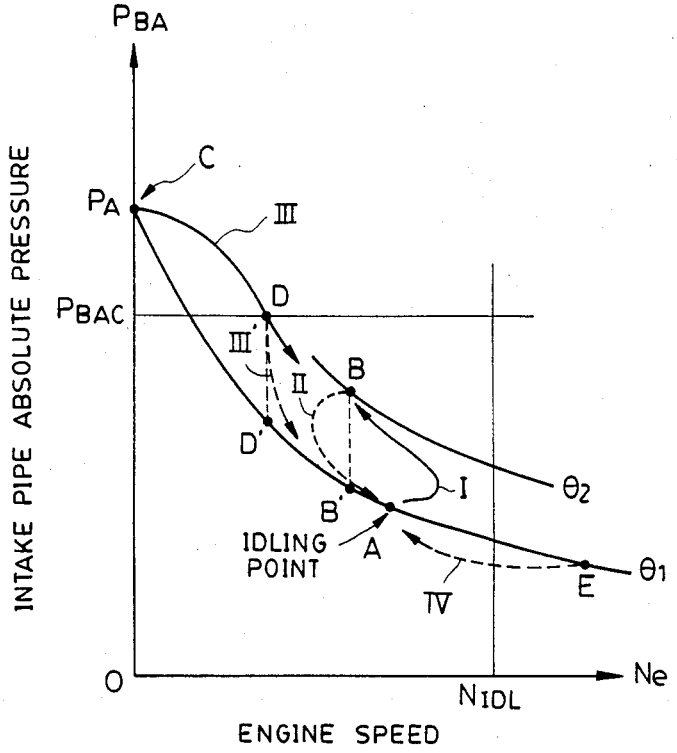
FIG. 1 is a graph showing a disadvantageous phenomenon with the conventional art, which can occur when control of the operating amount of an operation control means is switched from the SD method to the KMe method during a low load operating condition of the engine.

FIG. 1 shows how engine shock or engine stall occurs with a conventional method when a change occurs in the manner of setting the operating amount of an operation control means for controlling the operation of an internal combustion engine, for instance, when the manner of determining a quantity of fuel to be injected into the engine by means of a fuel supply control system is switched from the SD method to the KMe method, which can result in a sudden change in the fuel injection quantity to cause engine shock or engine stall.

Now, it is assumed that the engine is accelerated to the point B from the idling point A and thereafter resumes the idling point A. The idling point A lies on the line of engine operation along which the engine is operated with the valve opening of a throttle valve of the engine maintained in a fully closed position $\theta$1. Although the engine speed once increases along the operating line I as the throttle valve opening $\theta$TH is varied from the fully closed position $\theta$1 to an open position $\theta$2, the engine load also increases due to engagement of the engine clutch to decrease the engine speed. Therefore, the operating condition of the engine shifts to the point B which lies on a line along which the engine is operated with the throttle valve opening maintained in the constant open position $\theta$2. During transition of engine operation along the operating line I, the quantity of fuel to be injected into the engine is determined by the SD method since the engine is then operating in an accelerating condition with the throttle valve open.

Then, if the throttle valve is closed from the open position $\theta$2 to the fully closed position $\theta$1 and the clutch is again disengaged, the engine is determined to be operating in a predetermined low load condition. The predetermined low load operating condition of the engine with which the present invention is concerned includes, for instance, an engine operating condition wherein the throttle valve opening is smaller than a predetermined value for determining acceleration of the engine, the absolute pressure in the intake pipe of the engine downstream of the throttle valve is smaller than a reference value PBAC at which intake air forms a sonic flow in the intake pipe at a location where the throttle valve is arranged, and at the same time the engine rotational speed is smaller than a predetermined value NIDL which is larger than the idling speed. If the manner of determining the fuel injection quantity is switched from the SD method to the KMe method immediately when the above predetermined low load condition of the engine is determined, the engine operated at the point B is supplied with a quantity of fuel just corresponding to the throttle valve opening $\theta$1. That is, the engine is supplied with a quantity of fuel just corresponding to the engine operation point B′ on the same engine speed line as the point B lying on the steady line along which the engine is operated with the throttle valve maintained in the fully closed position $\theta$1, reuslting in a lean air/fuel mixture being supplied to the engine and accordingly a sudden drop in the engine speed along the operating line II, even often causing engine stall.

The operating line III in FIG. 1 shows a line along which the engine is started. That is, the engine is started by the action of the engine starter at the point C representing the inoperative state of the engine, and thereafter by the independent operation of the engine, the operating condition of the engine shifts toward the idling point A along the operating line III which is different from the aforementioned steady operating line $\theta$1 along which the engine is operated with the throttle valve opening kept in the fully closed position θ1. This is because the intake pipe is designed large in volume at a portion downstream of the throttle valve, as mentioned before, and accordingly the pressure in the intake pipe does not decrease promptly at the start of the engine. While the engine is operating on the way toward the idling point A along the operating line III, if the manner of determining the fuel injection quantity is switched from the SD method to the KMe method immediately when the above predetermined low load condition of the engine is detected due to a drop in the intake pipe absolute pressure PBA below the reference value PBAC (i.e. at the point D on the operating line III), the engine operated at the point D is supplied with a quantity of fuel just corresponding to the engine operation point D' on the same engine speed line as the point D lying on the steady operating line θ1. Therefore, the air/fuel mixture becomes lean in the same manner as described above, to retard reaching of the engine operation to the idling point A, as shown by the operating line III' in FIG. 1, even often causing engine stall.

Now, let it be assumed that while running down a long gentle slope, the engine is operating in a cruising condition at the operation point E in FIG. 1, which lies on the steady operating line θ1 with the throttle valve maintained in the fully closed position θ1. During engine operation in such operating condition, if the engine speed abruptly drops upon engine brake for instance, the intake pipe absolute pressure PBA does not promptly increase since the intake pipe is designed large in volume. As a consequence, the engine operating condition shifts toward the idling point A along the operating line IV which lies on the lower engine load side with respect to the operating line θ1. While the engine operating condition is on the way toward the idling point A along the operating line IV, if the manner of determining the fuel injection quantity is switched from the SD method to the KMe method immediately when the above predetermined low load operating condition of the engine is detected due to a drop in the engine speed Ne below the predetermined value NIDL, an excessive amount of fuel is supplied to the engine, in a manner reverse to the starting condition of the engine described above, to cause engine shock due to an abrupt increase in the fuel supply quantity, thus impeding the smooth operation of the engine.

Figure 2:
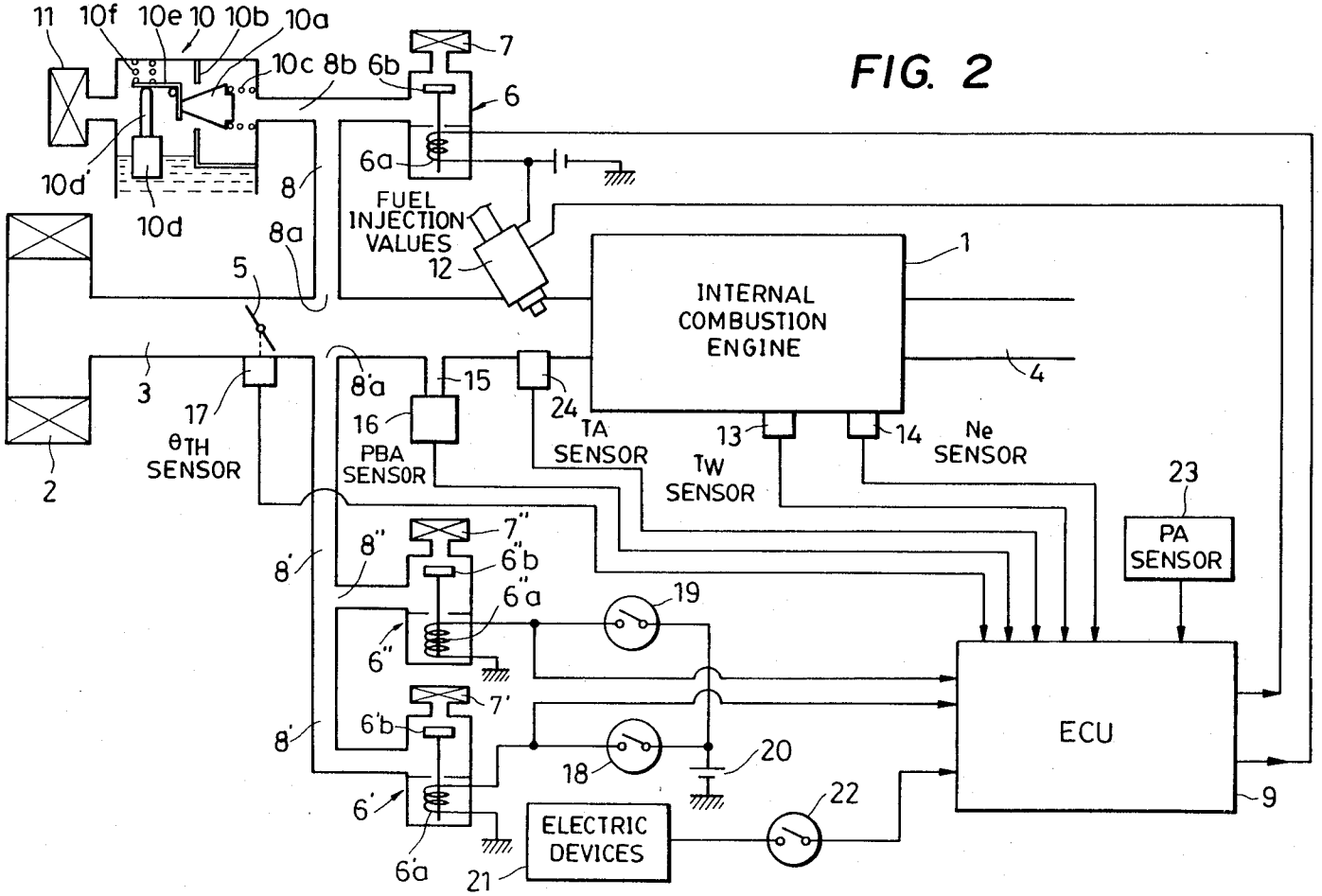
FIG. 2 is a block diagram of the whole arrangement of a fuel injection control system for internal combustion engines, to which is applied the method according to the present invention.

FIG. 2 schematically illustrates the whole arrangement of a fuel injection control system for internal combustion engines, which is equipped with a plurality of control valves for controlling the quantity of supplementary air being supplied to the engine. In the figure, reference numeral 1 designates an internal combustion engine which may be a four-cylinder type. Connected to the engine 1 are an intake pipe 3 with its air intake end provided with an air cleaner 2 and an exhaust pipe 4. Arranged in the intake pipe 3 is a throttle valve 5. A first air passage 8 and a second air passage 8' both open in the intake pipe 3 at a downstream side of the throttle valve 5 and communicate with the atmosphere. The first air passage 8 has an air cleaner 7 provided at an end thereof opening in the atmosphere. Arranged across the first air passage 8 is a first supplementary air quantity control valve (hereinafter merely called "the first control valve") 6 which is a normally closed type electromagnetic valve comprising a solenoid *6a* and a valve body *6b* disposed to open the first air passage 8 when the solenoid *6a* is energized, the solenoid *6a* being electrically connected to an electronic control unit (hereinafter abbreviated as "the ECU") 9.

A third air passage 8'' branches off from the second air passage 8'. The second air passage 8' and the third air passage 8'' have air cleaners 7' and 7'' provided at their respective ends opening in the atmosphere. A second supplementary air quantity control valve (hereinafter called "the second control valve") 6' is arranged across the second air passage 8' at a location between its junction with the third air passage 8'' and its end opening in the atmosphere, and a third supplementary air quantity control valve (hereinafter called "the third control valve") 6'' across the third air passage 8'', respectively. These second and third control valves 6' and 6'' are both normally closed type electromagnetic valves having similar structures to the first control valve 6. The control valves 6', 6'' each have a solenoid *6'a*, *6''a*, and a valve body *6'b*, *6''b* disposed to open its associated air passage when its corresponding solenoid *6'a*, *6''a* is energized. Each of the solenoids

*6'a*, *6''a* of the control valves 6', 6'' has one end grounded and the other end connected to a direct current power source 20 by way of a switch 18, 19, as well as to the ECU 9.

A branch passage *8b* branches off from the first air passage 8 at a location downstream of the first control valve 6 and has an air cleaner 11 provided at its end opening in the atmosphere. Arranged across the branch passage *8b* is a fast idling control device 10 which may comprise, as illustrated, a valve body *10a* disposed to be urged against its valve seat *10b* by the force of a spring *10c* to thereby close the branch passage *8b*, a sensor means *10d* responsive to the temperature of engine cooling water to stretch or contract its arm *10d'*, and a lever *10e* pivotable in response to the stretch and contraction of the arm *10d'* to cause displacement of the valve body *10a* in its closing or opening direction.

Fuel injection valves 12 and an intake air temperature (TA) sensor 24 are arranged in the intake pipe 3 at a location between the engine 1 and the open end *8a* of the first air passage 8 and the open end *8'a* of the second air passage 8'. An intake pipe absolute pressure (PBA) sensor 16 communicates through a pipe 15 with the interior of the intake pipe 3 at a location between the engine 1 and the open ends *8a*, *8'a*. The fuel injection valves 12 are connected to a fuel pump, not shown, and also electrically connected to the ECU 9, while the absolute pressure (PBA) sensor 16 and the intake air temperature (TA) sensor 24 are electrically connected to the ECU 9. A throttle valve opening (θTH) sensor 17 is operatively connected to the throttle valve 5, and an engine cooling water temperature (TW) sensor 13 is mounted on the main body of the engine 1. The latter sensor 13 may comprise a thermistor for instance, and may be inserted into the peripheral wall of an engine cylinder having its interior filled with cooling water, of which an output signal indicative of a detected cooling water temperature value is supplied to the ECU 9.

An engine speed sensor (hereinafter called "the Ne sensor") 14 is disposed around a camshaft, not shown, of the engine or a crankshaft, not shown, of same and adapted to generate a pulse as a top-dead-center (TDC) signal at each predetermined crank angle position of the crankshaft each time the crankshaft rotates through 180 degrees, the generated pulse being supplied to the ECU 9.

In FIG. 2, reference numeral 21 designates electrical devices such as headlamps, a brake lamp, and a radiator cooling fan, which are electrically connected to the ECU 9 by way of switches 22. Reference numeral 23 designates an atmospheric pressure (PA) sensor, of which an output signal indicative of a detected atmospheric pressure value is supplied to the ECU 9.

The fuel injection control system constructed as above operates as follows: First, the switch 18, which is operatively connected to an air conditioner switch, not shown, for turning on and off an air conditioner, supplies a signal indicative of an on state of the air conditioner to the ECU 9 when it is closed in response to turning-on of the air conditioner. At the same time, the closed switch 18 causes energization of the solenoid 6'a of the second control valve 6' to open the valve body 6'b so that a predetermined quantity of supplementary air is supplied to the engine 1, which corresponds to an increase in the engine load caused by the operation of the air conditioner during idle of the engine. The switch 19, which may be mounted on a shift lever, not shown, of an automatic transmission provided in the engine 1, is closed to supply an on-state signal (hereinafter called "the D-range signal") indicative of engagement of the automatic transmission when the shift lever is operated to a position of engagement of the automatic transmission. At the same time, the closed switch 19 causes energization of the solenoid 6''a of the third control valve 6'' to open the valve body 6''b so that a predetermined quantity of supplementary air is supplied to the engine 1, which corresponds to an increase in the engine load caused by the engagement of the automatic transmission during idle of the engine.

As stated above, the second control valve and the third control valve are provided, respectively, for the air conditioner and the automatic transmission which are auxiliary mechanical apparatuses directly driven by the engine and create relatively large mechanical loads applied upon the engine, so as to maintain the engine speed during idle at a substantially constant value even upon application of one or both of these large loads on the engine.

The fast idling control device 10 is adapted to operate when the engine cooling water temperature is lower than a predetermined value (e.g. 50 ° C.) such as at the start of the engine in cold weather. More specifically, the sensor means 10d stretches or contracts its arm 10d' in response to the engine cooling water temperature. This sensor means may comprise any suitable sensing means, such as wax filled within a casing, which is thermally expandable. When the engine cooling water temperature is lower than the above predetermined value, the arm 10d' is in a contracted state, with the lever 10e biased by the force of the spring 10f in such a direction as to displace the valve body 10a in a rightward direction as viewed in FIG. 2 against the force of the spring 10c whereby the branch passage 8b is opened. Since the open branch passage 8b allows supply of a sufficient amount of supplementary air to the engine through the filter 11 and the passages 8b, 8, the engine speed can be maintained at a higher value than a normal idling speed, thereby ensuring stable idling operation of the engine without the possibility of engine stall in cold weather.

As the arm 10d' of the sensor means 10d is stretched with a thermal expansion of the sensing medium caused by an increase in the engine cooling water temperature while the engine is warmed up, it pushes the lever 10e upward as viewed in FIG. 2 to rotate same in the clockwise direction. Then, the valve body 10a is moved leftward as viewed in FIG. 2, rather by the force of the spring 10c. When the engine cooling water temperature exceeds the predetermined value, the valve body 10a comes into urging contact with the valve seat 10b to close the branch passage 8b, thereby interrupting the supply of supplementary air through the fast idling control device 10.

On the other hand, the first control valve 6 is used for feedback control of the supplementary air quantity wherein the same quantity is varied so as to maintain the engine speed at a desired idling speed with accuracy. Also, it is used for increasing the amount of supplementary air by a predetermined amount corresponding to electrical load on the engine, which is relatively small, when one or more of the electrical devices 21 such as the headlamps, the brake lamp and the radiator cooling fan are switched on. To be specific, the ECU 9 operates on values of various signals indicative of operating conditions of the engine supplied from the throttle valve opening ($\theta$TH) sensor 17, the absolute pressure (PBA) sensor 16, the cooling water temperature (TW) sensor 13, the engine speed (Ne) sensor 14 and the atmospheric pressure (PA) sensor 23, as well as an electrical load signal supplied from the electrical devices 21 and in synchronism with generation of pulses of the TDC signal supplied from the Ne sensor 14, to determine whether or not the engine is in an operating condition requiring the supply of supplementary air through the first control valve 6, and also set a desired idling speed value. When it is determined that the engine is in such an operating condition requiring the supply of supplementary air, the ECU 9 calculates a value of supplementary air quantity to be supplied to the engine, that is, a valve opening duty ratio DOUT for the first control valve 6, in response to the difference between the actual engine speed value and the determined desired idling speed value so as to minimize the same difference, and supplies a driving signal corresponding to the calculated duty ratio value, to the first control valve 6 to operate same.

The first control valve 6 has its solenoid 6a energized for a valve opening period corresponding to the above calculated duty ratio DOUT to open the first air passage 8 so that a required quantity of supplementary air corresponding to the valve opening period of the valve 6 is supplied to the engine 1 through the first air passage 8 and the intake pipe 3.

On the other hand, the ECU 9 also operates on values of the aforementioned various engine operating parameter signals and in synchronism with generation of pulses of the TDC signal to calculate the fuel injection period TOUT for the fuel injection valves 12 by the use of the following equation:

$$TOUT = Ti \times K1K2 \quad (1)$$

where Ti represents a basic fuel injection period, which is determined according to the aforementioned SD method or the KMe method, depending upon whether or not the engine is operating in an operating region wherein a predetermined idling condition is fulfilled, as hereinafter described in detail.

In the above equation, K1 and K2 represent correction coefficients or correction variables which are calculated on the basis of values of engine operating parameter signals supplied from the aforementioned various sensors such as the throttle valve opening ($\theta$TH) sensor 17, the atmospheric pressure (PA) sensor 23, the intake air temperature (TA) sensor 24. For instance, the correction coefficient K1 is calculated by the use of the following equation:

$$K1 = KTA \times KPA \times KTW \times KWOT \quad (2)$$

where KTA represents an intake air temperature-dependent correction coefficient, and KPA an atmospheric pressure-dependent correction coefficient, respectively. These correction coefficients KTA and KPA are determined by the use of respective predetermined equations selectively applied in response to the method to be applied, i.e. the SD method or the KMe method, so as to set the coefficients KTA, KPA at values most appropriate to the SD method or the KMe method, as hereinafter described in detail.

In the above equation (2), KTW represents a coefficient for increasing the fuel supply quantity, which has its value determined in dependence on the engine cooling water temperature TW sensed by the engine cooling water temperature (TW) sensor 13, and KWOT a mixture-enriching coefficient applicable at wide-open-throttle operation of the engine and having a constant value, respectively.

The ECU 9 supplies the fuel injection valves 12 with driving signals corresponding to the fuel injection period TOUT calculated as above, to open the same valves.

Figure 3:
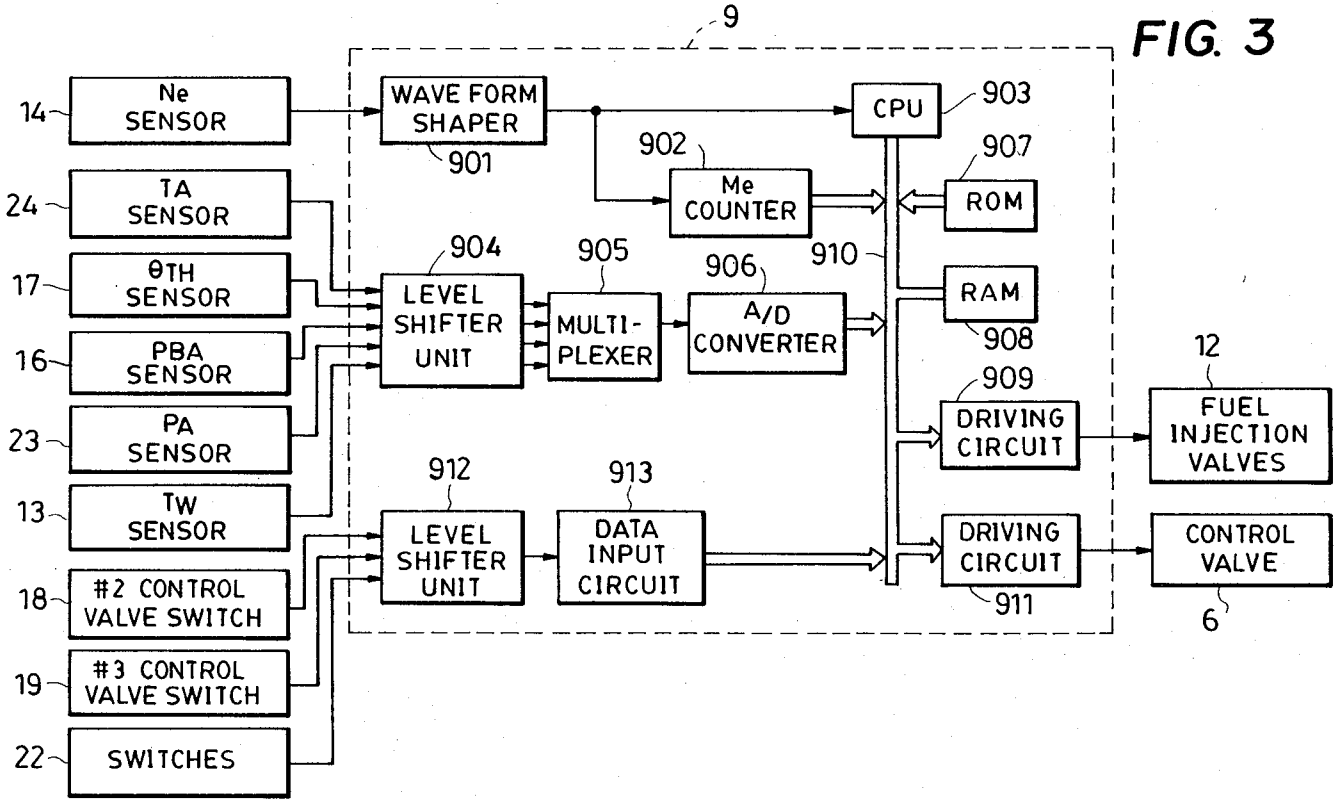
FIG. 3 is a circuit diagram of the interior construction of an electronic control unit (ECU) appearing in FIG. 2.

FIG. 3 shows a circuit configuration within the ECU 9 in FIG. 2. An output signal from the engine speed (Ne) sensor 14 is applied to a waveform shaper 901, wherein it has its pulse waveform shaped, and supplied to a central processing unit (hereinafter called "the CPU") 903, as the TDC signal, as well as to an Me value counter 902. The Me value counter 902 counts the interval of time between a preceding pulse of the TDC signal and a present pulse of same, inputted thereto from the Ne sensor 14, and therefore its counted value Me is proportional to the reciprocal of the actual engine speed Ne. The Me value counter 902 supplies the counted value Me to the CPU 903 via a data bus 910.

The respective output signals from the throttle valve opening ($\theta$TH) sensor 17, the intake pipe absolute pressure (PBA) sensor 16, the engine cooling water temperature (TW) sensor 13, the atmospheric pressure (PA) sensor 23, and the intake air temperature (TA) sensor 24 appearing in FIG. 2 have their voltage levels shifted to a predetermined voltage level by a level shifter unit 904 and successively applied to an analog-to-digital converter 906 through a multiplexer 905. The analog-to-digital converter 906 successively converts into digital signals analog output voltages from the aforementioned various sensors, and the resulting digital signals are supplied to the CPU 903 via the data bus 910.

On-off state signals supplied from the switch 18 for opening the second control valve 6' during operation of the air conditioner, the switch 19 for opening the third control valve 6'' during engagement of the automatic transmission, and the switches 22 for the electrical devices 21, all appearing in FIG. 2, are supplied to another level shifter unit 912 wherein the signals have their voltage levels shifted to a predetermined voltage level, and the level shifted signals are processed by a data input circuit 913 and applied to the CPU 903 through the data bus 910.

Further connected to the CPU 903 via the data bus 910 are a read-only memory (hereinafter called "the ROM") 907, a random access memory (hereinafter called "the RAM") 908 and driving circuits 909 and 911. The RAM 908 temporarily stores various calculated values from the CPU 903, while the ROM 907 stores a control program executed within the CPU 903, etc.

The CPU 903 executes the control program stored in the ROM 907 to determine operating conditions of the engine from the values of the aforementioned various engine operating parameter signals and the on-off state signals from the switches 18, 19 and 22 to calculate the valve opening duty ratio DOUT for the first control valve 6 and also calculate the fuel injection period TOUT for the fuel injection valves 12 in accordance with the determined operating conditions of the engine in a manner hereinafter described in detail, and supplies control signals corresponding to the resulting calculated values to the driving circuits 911 and 909 through the data bus 910. The driving circuits 911, 909 supply driving signals to the first control valve 6 and the fuel injection valves 12, respectively, to open same as long as they are supplied with the respective control signals.

Figure 4:
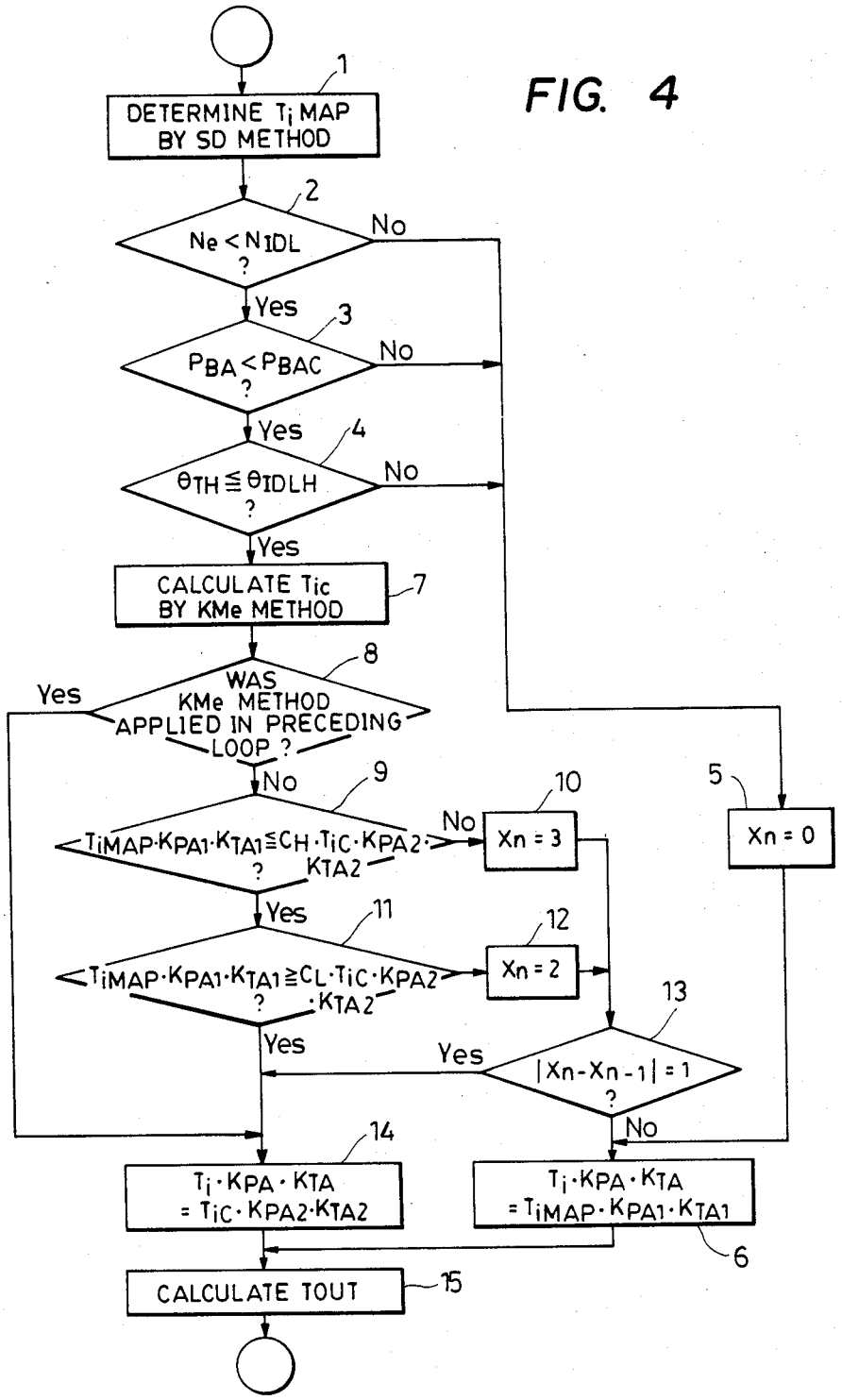
FIG. 4 is a flowchart of a program executed within the ECU for calculating fuel injection period TOUT.

FIG. 4 shows a flowchart of a program for calculating the valve opening period TOUT of the fuel injection valves 12, which is executed within the CPU 903 in FIG. 3 in synchronism with generation of pulses of the TDC signal.

Figure 5:
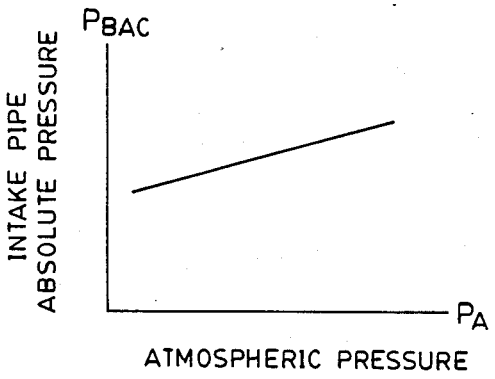
FIG. 5 is a graph showing the relationship between a reference value PBAC of intake pipe absolute pressure and atmospheric pressure PA.

First, at the step 1 in FIG. 4, a basic fuel injection period TiMAP is determined according to the SD method. The determination of the basic fuel injection period TiMAP by the SD method is carried out by reading a TiMAP value corresponding to detected values of the intake pipe absolute pressure PBA and the engine speed Ne, from a basic fuel injection period map stored in the ROM 907 in FIG. 3. Then, the steps 2 through 4 are executed to determine whether or not the aforementioned predetermined idling condition of the engine is fulfilled. At the step 2, a determination is made as to whether or not the engine rotational speed Ne is below a predetermined value NIDL (e.g. 1000 rpm). If the determination provides a negative result (no), it is regarded that the predetermined idling condition is not fulfilled, and the program jumps to the steps 5 and 6, hereinafter referred to. If the answer to the question of the step 2 is yes, the program proceeds to the step 3 wherein it is determined whether or not the intake pipe absolute pressure PBA is on the lower engine load side with respect to a predetermined reference value PBAC, that is, whether or not the former is lower than the latter. This predetermined reference pressure value PBAC is set at such a value as to determine whether or not the ratio (PBA/PA') of the absolute pressure PBA in the intake pipe 3 downstream of the throttle valve 5 to the absolute pressure PA' in the intake pipe upstream of the throttle valve 5 is lower than a critical pressure ratio (=0.528) at which the flow velocity of intake air passing the throttle valve 5 is equal to the velocity of sound. The reference pressure value PBAC is given by the following equation:

$$PBAC = PA' \times (\text{critical pressure ratio}) \quad (3)$$

$$= PA' \times [2/(\eta + 1)]^{\frac{\eta}{\eta - 1}} = 0.528 \times PA$$

where $\mu$ represents the ratio of specific heat of air (=1.4). Since the absolute pressure PA' in the intake pipe 3 upstream of the throttle valve 5 is approximate or substantially equal to the atmospheric pressure PA sensed by the atmospheric pressure (PA) sensor 23 in FIG. 2, the relationship of the above equation (3) can stand. The relationship between the reference pressure PBAC and the atmospheric pressure PA, given by the equation (3), is shown in FIG. 5.

Referring again to FIG. 4, if the answer to the question of the step 3 is negative or no, it is regarded that the predetermined idling condition is not fulfilled, and the program proceeds to the steps 5 and 6, whereas if the answer is yes, the step 4 is executed. In the step 4, a determination is made as to whether or not the valve opening θTH of the throttle valve 5 is smaller than a predetermined value θIDLH. This determination is necessary for the following reason: In the event that the engine operating condition shifts from an idling condition wherein the throttle valve 5 is almost closed to an accelerating condition wherein the throttle valve is suddenly opened from the almost closed position, if this transition to the accelerating condition is detected solely from changes in the engine rotational speed and the intake pipe absolute pressure as in the aforementioned steps 2 and 3, there is a delay in the detection due to the response lag of the absolute pressure sensor 16. Therefore, a change in the valve opening of the throttle valve 5 is utilized for quick detection of such accelerating condition. If the engine is thus determined to have entered an accelerating condition, a required quantity of fuel should be calculated according to the SD method for supply to the engine.

If the answer to the question of the step 4 is negative or no, it is regarded that the predetermined idling condition is not satisfied, and then the steps 5 and 6 are executed, while if the answer is yes, the step 7 is executed.

In the step 5 which is executed when the predetermined idling condition is not fulfilled, the value of a control variable Xn, hereinafter referred to, is set to zero, which has been obtained in the present loop of execution of the program. Then, in the step 6, the values of the atmospheric pressure-dependent correction coefficient KPA and the intake air temperature-dependent correction coefficient KTA are set, respectively, to KPA1 and KTA1 applicable to the SD method, and the product term Ti×KPA×KTA is calculated by using the basic fuel injection period TiMAP value as a Ti value, obtained in the step 1, for application to the aforementioned equation (1):

$$Ti \times KPA \times KTA = TiMAP \times KPA1 \times KTA1 \quad (4)$$

The KPA1 value of the atmospheric pressure-dependent correction coefficient KPA applicable to the SD method is given by the following equation, as disclosed in Japanese Provisional Patent Publication No. 58-85337:

$$KPA1 = \frac{1 - (1/\epsilon)\,(PA/PBA)^{1/\mu}}{1 - (1/\epsilon)\,(PA0/PBA)^{1/\mu}} \quad (5)$$

where PA represents actual atmospheric pressure (absolute pressure), PA0 standard atmospheric pressure, $\epsilon$ the compression ratio, and $\mu$ the ratio of specific heat of air, respectively. Calculation of the atmospheric pressure-dependent correction coefficient KPA1 value by the use of the above equation (5) is based upon the recognition that the quantity of air being sucked into the engine per suction cycle of same can be theoretically determined from the intake pipe absolute pressure PBA and the absolute pressure in the exhaust pipe which can be regarded as almost equal to the atmospheric pressure PA, and the fuel supply quantity may be varied at a rate equal to the ratio of the intake air quantity at the actual atmospheric pressure PA to the intake air quantity at the standard atmospheric pressure PA0.

When the relationship PA<PA0 stands in the equation (5), the KPA1 value of the atmospheric pressure-dependent coefficient KPA is larger than 1. So long as the intake pipe absolute pressure PBA remains the same, the quantity of intake air being sucked into the engine becomes larger at a high altitude where the atmospheric pressure PA is lower than the standard atmospheric pressure PA0, than at a lowland. Therefore, if the engine is supplied with a fuel quantity determined as a function of the intake pipe absolute pressure PBA and the engine rotational speed Ne in a low atmospheric pressure condition such as at high altitudes, it can result in a lean air/fuel mixture. However, such leaning of the mixture can be avoided by employing the above fuel increasing coefficient KPA1 value.

On the other hand, the KTA1 value of the intake air temperature-dependent correction coefficient KTA1 applicable to the SD method is given by the following equation, as disclosed in U.S. Pat. No. 4,465,051:

$$KTA1 = \frac{1}{1 + CTAMAP(TA - TA0)} \quad (6)$$

where TA represents the temperature (°C.) of intake air flowing through the intake pipe, and TA0 a calibration variable, which is set e.g. to 50° C., respectively. CTAMAP represents a calibration coefficient having its value set to a constant value (e.g. $1.26\times10^{-3}$) in dependence upon the operating characteristics of the engine. In the above equation (6), since the value of CTAMAP(TA−TA0) is smaller than 1, the coefficient KTA1 can be approximately determined by the following equation:

$$KTA1 = 1 - CTAMAP(TA - TA0) \quad (7)$$

When all the determinations at the steps 2 through 4 in FIG. 4 provide affirmative answers and therefore it is regarded that the predetermined idling condition of the engine is fulfilled, the step 7 is executed to calculate the value of basic fuel injection period Tic according to the KMe method.

Figure 6:
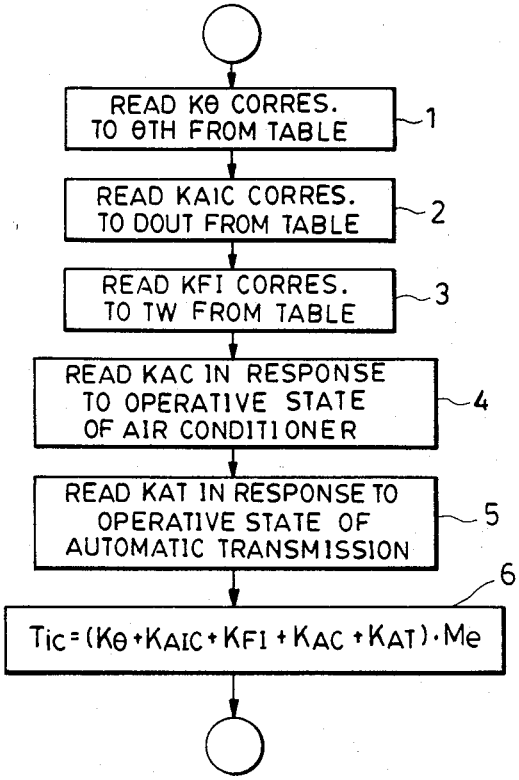
FIG. 6 is a flowchart showing a manner of determining a basic fuel injection period Tic value according to the KMe method, which is executed at the step 7 in FIG. 4.

FIG. 6 shows a manner of determining the basic fuel injection period Tic value according to the KMe method, which is executed at the step 7 in FIG. 4. First, an equation for calculation of the basic fuel injection period Tic value according to the KMe method is derived as follows:

When absolute pressure in an intake pipe of an internal combustion engine at a downstream side of a throttling portion therein such as a throttle valve arranged in the intake pipe is lower than a critical value as employed in the step 3 in FIG. 4, intake air passing the throttling portion forms a sonic flow or a critical flow so that the flow rate of air Ga(A) through the throttling portion per unit time (in gravity or weight) remains constant so long as the opening area A of the throttling portion remains constant. On the other hand, during idling of the engine, the flow rate of fuel Gf supplied to the engine per unit time (in gravity or weight) required for obtaining a predetermined air/fuel ratio (A/F)o can be expressed as follows:

$$Gf = \frac{Ga(A)}{(A/F)o} \quad (8)$$

The same fuel flow rate Gf can also be given by the following equation:

$$Gf = \frac{2Ne}{60} \times \gamma f \times \frac{\Delta Q}{\Delta Ti} \times \frac{Ti}{1000} \quad (9)$$

$$= \frac{\gamma f}{Me} \times \frac{\Delta Q}{\Delta Ti} \times Ti$$

where 2Ne/60 represents a number of times of fuel injection into a four-cylinder engine per unit time (sec), $\gamma f$ the specific weight of fuel, ($\Delta Q/\Delta Ti$) a volumetric quantity of fuel injected from the fuel injection valves 12 per unit valve opening period, Ti the basic fuel injection period (msec), and Me the pulse separation of the TDC signal (msec), respectively. The pulse separation Me can be determined from the engine rotational speed Ne by the use of an equation of Me=60/2Ne. The following equation is derived from the above equations (8) and (9):

$$Tic = \frac{Ga(A)}{(A/F)o \times (\Delta Q/\Delta Tic) \times \gamma f} \times Me$$

Here, an opening area coefficient K(A) of the throttling portion is provided by the following equation:

$$K(A) = \frac{Ga(A)}{(A/F)o \times (\Delta Q/\Delta Tic) \times \gamma f}$$

Thus, Tic can be expressed as follows:

$$Tic = K(A) \times Me \quad (10)$$

Since the opening area coefficient K(A) has a value proportional to the opening area A of the throttling portion, if opening area coefficients of the throttle valve 5, the first to third control valves, and the fast idling control device 10 are designated by K$\theta$, KAIC, KAC, KAT and KFI, respectively, the following equation can be derived from the equation (10):

$$Tic = K(A) \times Me = (K\theta + KAIC + KAC + KAT + KFI) \times Me \quad (10)'$$

Figure 7:
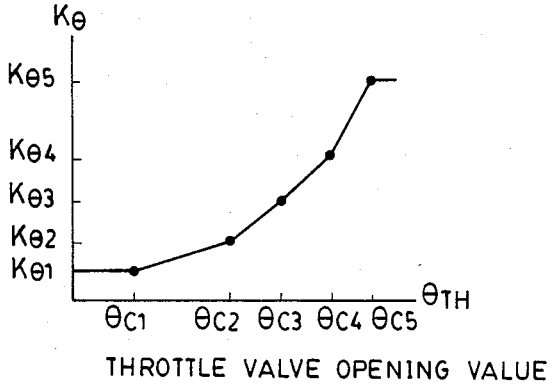
FIG. 7 is a graph showing a table of the relationship between a coefficient K$\theta$ dependent on the valve opening area of the throttle valve and throttle valve opening $\theta$TH.

In FIG. 6, the step 1 is provided to determine the value of the opening area coefficient K$\theta$ of the throttle valve 5. The same value K$\theta$ is determined from a graph or a table in FIG. 7, showing the relationship between the throttle valve opening $\theta$TH and the opening area coefficient K$\theta$. As a practical measure for realizing this, for instance, the ROM 907 in the ECU 9 stores beforehand predetermined values K$\theta$1 through K$\theta$5 as the value K$\theta$ corresponding, respectively, to predetermined throttle valve opening values $\theta$c1 through $\theta$c5. Two adjacent K$\theta$ values close to the actual throttle valve opening $\theta$TH are read from the ROM 907 and subjected to an interpolation to determine a coefficient value K$\theta$ exactly corresponding to the actual throttle valve opening value $\theta$TH.

Figure 8:
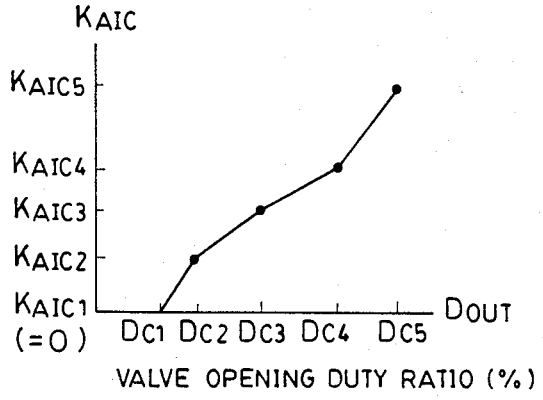
FIG. 8 is a graph showing a table of the relationship between a coefficient KAIC dependent on the valve opening area of a first control valve appearing in FIG. 2, and valve opening duty ratio DOUT for the same control valve.

Next, in the step 2 of FIG. 6, the valve opening area coefficient value KAIC of the first control valve 6 is determined. The valve opening area of the first control valve 6 and accordingly the value KAIC can be determined as a function of the valve opening duty ratio DOUT. FIG. 8 shows a table of the relationship between the valve opening duty ratio DOUT of the first control valve 6 and the valve opening area coefficient KAIC thereof. In the same manner as the above-described manner of determining the valve opening area coefficient value K$\theta$ of the throttle valve can be determined the valve opening area coefficient KAIC value corresponding to the valve opening duty ratio of the first control valve 6, and accordingly corresponding to the valve opening area of same.

Figure 9:
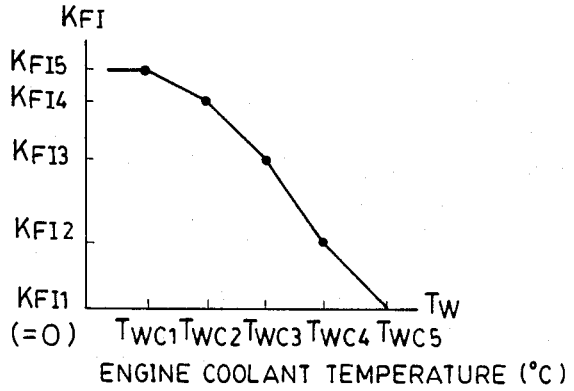
FIG. 9 is a graph showing a table of the relationship between a coefficient KFI dependent on the passage opening area of a fast idling control device appearing in FIG. 2, and engine cooling water temperature TW.

The step 3 in FIG. 6 is provided to determine the passage opening area coefficient KFI value of the fast idling control device 10 in FIG. 2. The passage opening area and accordingly the value KFI of the fast idling control device 10 can be determined as a function of the engine cooling water temperature TW. FIG. 9 shows a table of the relationship between the engine cooling water temperature TW and the passage opening area coefficient KFI. In the same manner as the aforedescribed manner of determining the valve opening area coefficient K$\theta$ of the throttle valve can be determined the passage opening area coefficient KFI value of the fast idling control device 10.

In the step 4, the valve opening area coefficient KAC value of the second control valve 6' is determined. Since the second control valve 6' is disposed to be fully opened or fully closed in response to on- and off-states of the switch 18 operable in response to operation of the air conditioner switch, a predetermined value KAC corresponding to a value of the valve opening area of the second control valve 6' in fully open position is read from the ROM 907 when the switch 18 is in an on or closed state.

The step 5 is executed only in the event that the method of the present invention is applied to an internal combustion engine equipped with an automatic transmission. When the third control valve 6'' is fully opened by a signal indicative of the on-state of the switch 19 representing engagement of the automatic transmission, a predetermined value KAT corresponding to a value of the valve opening area of the third control valve 6'' in fully open position is read from the ROM 907.

The CPU 903 calculates a sum of the values of the above-mentioned opening area coefficients determined as above, by the use of the equation (10)', and multiplies the resulting sum by a value Me supplied from the Me value counter 902 to calculate the basic fuel injection period Tic, at the step 6.

Reverting to FIG. 4, after calculating the basic fuel injection period Tic according to the KMe method at the step 7, the program proceeds to the step 8 to determine whether or not the value of fuel injection period was determined by the KMe method in the preceding loop. If, in the preceding loop, the KMe method was applied to determine the value of fuel injection period (hereinafter called "idle mode"), the program jumps to the step 14 without executing the steps 9 through 13, hereinafter referred to, whereas if the the preceding loop was not effected in idle mode, that is, when the determination at the step 8 provides a negative answer, the program proceeds to the steps 9 through 13 with which the present invention is concerned.

In the steps 9 and 11, the atmospheric pressure-dependent correction coefficient KPA1 value and the intake air temperature-dependent correction coefficient KTA1 value both applicable to the SD method are determined, respectively, in the same manner as the aforementioned step 6, and also an atmospheric pressure-dependent correction coefficient KPA2 value and an intake air temperature-dependent correction coefficient KTA2 value applicable to the KMe method are determined, respectively. These coefficient values KPA2 and KTA2 are determined in the following manner:

When the ratio (PBA/PA') of intake pipe pressure PBA downstream of the throttling portion such as a throttle valve to intake pipe pressure PA' upstream of the throttling portion is smaller than the critical pressure ratio (=0.528), intake air passing the throttling portion forms a sonic flow. The flow rate Ga(g/sec) of intake air can be expressed as follows:

$$Ga = A \times C \times PA \times \sqrt{\left(\frac{2}{\eta + 1}\right)^{\frac{\eta+1}{\eta-1}} \times \frac{g\eta}{R(TAF + 273)}} \quad (11)$$

where A represents equivalent opening area ($mm^2$) of the throttling portion such as the throttle valve, C a correction coefficient having its value determined by configuration, etc. of the throttling portion, PA atmospheric pressure (PA≈PA', mmHg), $\mu$ the ratio of specific heat of air, R the gas constant of air, TAF the temperature (°C.) of intake air immediately upstream of the throttling portion, and g the gravitational acceleration ($m/sec^2$), respectively. So long as the intake air temperature TAF and the opening area A remain constant, the ratio of the flow rate of intake air Ga (in gravity or weight) under the actual atmospheric pressure PA to the flow rate of intake air Ga0 (in gravity or weight) under the standard atmospheric pressure PA0 can be expressed as follows:

$$\frac{Ga}{Ga0} = \frac{PA}{PA0}$$

If the quantity of fuel being supplied to the engine is varied at a rate equal to the above ratio of flow rate of intake air, the resulting air/fuel ratio is maintained at a constant value. Therefore, the flow rate Gf of fuel can be determined from the flow rate Gf0 of same under the standard atmospheric pressure PA0 (=760 mmHg), as expressed by the following equation:

$$Gf = Gf0 \times \frac{PA}{760}$$

Here, the atmospheric pressure-dependent correction coefficient KPA2 value can be theoretically expressed as follows:

$$KPA2 = \frac{PA}{760}$$

In practice, however, various errors resulting from configuration, etc. of the intake passage should be taken into account, and therefore the above equation can be expressed as follows:

$$KPA2 = 1 + CPA \times \frac{PA - 760}{760} \quad (12)$$

where CPA represents a calibration variable which is determined experimentally.

According to the equation (12), when the relationship PA<760 mmHg stands, the correction coefficient KPA2 value is smaller than 1. Since according to the KMe method, the quantity of intake air is determined solely from the equivalent opening area A of the throttling portion in the intake passage with reference to the standard atmospheric pressure PA0, it decreases in proportion as the atmospheric pressure PA decreases such as at a high altitude where the atmospheric pressure PA is lower than the standard atmospheric pressure PA0. Therefore, if the fuel quantity is set in dependence on the above opening area A, the resulting air/fuel mixture becomes rich, in a manner reverse to the SD method. However, such enriching of the mixture can be avoided by employing the above correction coefficient KPA2 value.

In the aforementioned equation (11), so long as the atmospheric pressure PA and the opening area A remain constant, the ratio of the flow rate Ga0 of intake air assumed when the temperature of air upstream of the throttling portion is equal to a reference temperature TAF0, to the flow rate Ga of intake air at a given temperature TAF can be given by the following equation:

$$\frac{Ga}{Gao} = \sqrt{\frac{TAF0 + 273}{TAF + 273}}$$

If the quantity of fuel being supplied to the engine is varied at a rate equal to the above ratio of flow rate of intake air, the resulting air/fuel ratio is maintained at a constant value. Therefore, the flow rate Gf of fuel can be determined from the flow rate Gf0 of same at the reference temperature TAF0, as expressed by the following equation:

$$Gf = Gf0\sqrt{\frac{TAF0 + 273}{TAF + 273}}$$

Here, the intake air temperature-dependent correction coefficient KTA2 value can be expressed as follows:

$$KTA2 = \sqrt{\frac{TAF0 + 273}{TAF + 273}}$$

Therefore, the correction coefficient KTA2 value can be approximated by the following equation:

$$KTA2 \approx 1 - \frac{TAF - TAF0}{2(TAF + 273)} \approx 1 - \alpha(TAF - TAF0) \quad (13)$$

Thus, the above correction coefficient KTA2 value is determined as a function of the temperature TAF of intake air upstream of the throttling portion. It has been experimentally ascertained that the functional relationship between the intake air temperature TAF upstream of the throttling portion and the intake air temperature TA downstream of same is approximated by the following equation, when the engine is in an idling condition:

$$TAF = a \times TA + b \quad (14)$$

where a and b represent constants. Taking the relationship of $TAF0 = a \times TA0 + b$ into consideration, the equation (13) can be expressed as follows, by substituting the equation (14) into the equation (13):

$$KTA2 = 1 - a \times \alpha(TA - TA0) = 1 - CTAC(TA - TA0) \quad (15)$$

Thus, the intake air temperature-dependent correction coefficient KTA2 value can be given by the simplified equation (15).

Reverting to FIG. 4, it is determined whether or not a value of the product term Ti×KPA×KTA calculated according to the SD method is substantially equal to a value of the same product term calculated according to the KMe method, by the use of the correction coefficient values determined as above and the basic fuel injection period values TiMAP, Tic obtained at the steps 1 and 7. More specifically, at the step 9, a determination is made as to whether or not the product value TiMAP×KPA1×KTA1 calculated by the SD method is smaller than or equal to a value obtained by multiplying the product value Tic×KPA2×KTA2 calculated according to the KMe method by a predetermined upper limit coefficient CH (e.g. 1.05), and then at the step 11, it is determined whether or not the above product value TiMAP×KPA1×KTA1 is larger than or equal to a value obtained by multiplying the product value Tic×KPA2×KTA2 calculated according to the KMe method by a predetermined lower limit coefficient CL (e.g. 0.95).

The predetermined upper and lower limit coefficients CH and CL are determined experimentally and set at such optimum values as to achieve smooth and stable operation of the engine.

When both of the determinations at the steps 9 and 11 provide affirmative answers, it is regarded that the product value TiMAP×KPA1×KTA1 calculated by the SD method is substantially equal to the product value Tic×KPA2×KTA2 calculated by the KMe method. The program then proceeds to the step 14 wherein the values of the basic fuel injection period Tic and the correction coefficients KPA2 and KTA2 all calculated by the KMe method are substituted for the product term Ti×KPA×KTA to be applied to the aforementioned equation (1):

$$Ti \times KPA \times KTA = Tic \times KPA2 \times KTA2 \quad (16)$$

Figure 10:
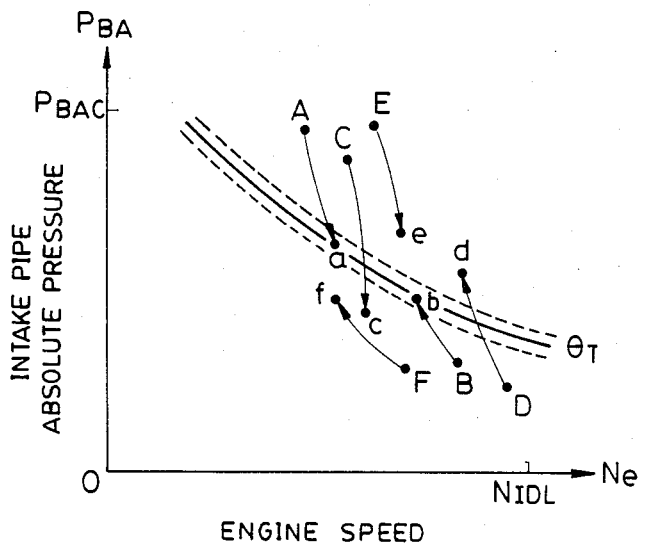
FIG. 10 is a graph showing various changes in engine operation which can occur during operation of the engine in low load condition of the engine.

FIG. 10 is a diagram similar to FIG. 1, showing the relationship between results of determinations carried out at the steps 9 through 13 in FIG. 4 and various operating conditions of the engine, represented in terms of the intake pipe absolute pressure PBA and the engine speed Ne. Affirmative results obtained at the above steps 9 and 11 mean that, for instance, between execution of the preceding loop and the present loop, the point of operation of the engine has shifted from the point A or B in the figure to the point a or b which can be regarded as substantially lying on a steady operating line of the engine along which the valve opening of the throttle valve is maintained at a value θT smaller than the aforementioned predetermined value θIDLH (in FIG. 10, the points a and b lie in a region defined between the two broken lines which are so set as to correspond to the aforementioned predetermined upper and lower limit coefficients CH, CL). Therefore, when such affirmative determinations are obtained, that is, when the answers to the questions at the steps 9 and 11 are both yes, an abrupt change does not occur in the fuel supply quantity even if the manner of determining the fuel supply quantity is switched from the SD method to the KMe method, thus achieving smooth operation of the engine at changeover of the fuel supply control method.

Referring to FIG. 4, when the answer to the question at the step 9 is negative or no, the value of the aforementioned control variable Xn is set to 3 in the present loop (the step 10), while when the answer to the question at the step 11 is no, it is set to 2 (the step 12). Next, at the step 13, it is determined whether or not the difference between the value Xn−1 of the control variable assumed in the preceding loop and the value Xn of same set in the present loop at the step 10 or 12 is equal to 1. This determination is to determine whether or not the point of operation of the engine has shifted substantially across the steady operating line along which the throttle valve opening keeps the value θT detected in the present loop, between the preceding loop and the present loop. That is, it is determined that the operating point of the engine has not shifted across the steady operating line along which the throttle valve opening keeps the value θT detected in the present loop, between the preceding loop and the present loop (i.e. the operating lines E→e, F→f in FIG. 10), in the following cases: when the predetermined idling condition of the engine was not fulfilled in the preceding loop (i.e. $Xn-1=0$, as set at the step 5 in the preceding loop) and the value of the control variable Xn is set to 3 in the present loop (the step 10) as the result of a negative determination at the step 9, when the determinations at the step 9 provide negative answers both in the present loop and in the preceding loop (i.e. $Xn=Xn-1=3$), or when the determinations at the step 9 provide affirmative answers both in the present loop and in the preceding loop and at the same time the determination at the step 11 provides a negative answer (i.e. $Xn=Xn-1=2$). On such occasions, the answer to the question at the step 13 becomes negative, and the SD method is continually applied to calculate the fuel injection period (the aforementioned step 6).

On the other hand, it is determined that the operating point of the engine has shifted across the steady operating line along which the throttle valve opening keeps the value θT detected in the present loop (i.e. the operating lines C→c, D→d in FIG. 10) between the preceding loop and the present loop, in the following cases: when the answers to the questions at the steps 9 and 11 were, respectively, yes and no in the preceding loop (i.e. $Xn-1=2$), and at the same time the value of the control variable Xn is set to 3 in the present loop as the result of a negative determination at the step 9, or when the step 10 was executed in the preceding loop (i.e. $Xn-1=3$), and at the same time the step 12 is executed in the present loop (i.e. Xn=2). That is, on such occasions, the fuel injection period value calculated is substantially the same whichever of the SD method or the KMe method is employed, if the calculation is made at an intermediate time point between the preceding loop and the present loop. Therefore, on such occasions, the fuel supply control should preferably be promptly switched to the KMe method. Accordingly, when the determination at the step 13 provides an affirmative answer, calculation of the product term Ti×KPA×KTA is carried out according to the KMe method, at the aforementioned step 14.

Then, the resulting value of the product term Ti×KPA×KTA obtained at the step 6 or 14 is applied to the aforementioned equation (1), and at the same time values of the correction coefficients and correction variables appearing in the equation (2) are calculated, to determine the fuel injection period TOUT for the fuel injection valves 12, at the step 15, followed by termination of execution of the program.

In the above steps 2 through 4, the respective predetermined values of parameters for determining the predetermined idling condition of the engine may each be set at different values between entrance of the engine operation into a region in which the predetermined idling condition is fulfilled and departure therefrom, so that a hysteresis characteristic can be imparted at changeover from the KMe method to the SD method or vice versa, thereby achieving stable control of operation of the engine.

Further, the method of the present invention is not limited to the fuel injection quantity control for the fuel injection control system, described above, but it may be applied to other operation control means for controlling the engine, such as an ignition timing control system and an exhaust gas recirculation control system, so far as the operating amounts of these systems are determined in dependence on the intake air quantity.

What is claimed is:

1. A method of electronically controlling an operating amount of an operation control means for controlling the operation of an internal combustion engine, comprising the steps of: (1) detecting a value of a first engine operating parameter indicative of loaded conditions of said engine; (2) detecting a value of a second engine operating parameter indicative of loaded conditions of said engine; (3) determining whether or not said engine is operating in a predetermined low load condition; (4) determining a desired operating amount of said operation control means in dependence on the detected value of said first engine operating parameter obtained at said step (1) when said engine is determined to be operating in said predetermined low load condition; (5) determining the desired operating amount of said operation control means in dependence on the detected value of said second engine operating parameter obtained at said step (2) when said engine is determined not to be operating in said predetermined low load condition; (6) determining first and second provisional desired operating amounts of said operation control means, respectively, in dependence on the detected values of said first and second engine operating parameters, when it is determined that said engine has entered said predetermined low load condition from a condition other than said predetermined low load condititon; (7) comparing the determined first provisional desired operating amount with the determined second provisional desired operating amount; (8) determining the desired operating amount of said operation control means in dependence on the determined second provisional desired operating amount from the time it is determined that said engine has entered said predetermined low load condition to the time the determined second provisional desired operating amount becomes substantially equal to the determined first provisional desired operating amount, even while said engine is actually operating in said predetermined low load condition; and (9) controlling the operating amount of said operation control means on the basis of the desired operating amount determined at said step (4), (5) or (8).

2. A method as claimed in claim 1, wherein the operating amount of said operation control means is controlled on the basis of the desired operating amount determined at said step (4) when said second provisional desired operating amount determined at said step (6) decreases across a value substantially equal to said first provisional desired operating amount determined at said step (6).

3. A method as claimed in claim 1, wherein the operating amount of said operation control means is controlled on the basis of the desired operating amount determined at said step (4) when said second provisional desired operating amount determined at said step (6) exceeds across a value substantially equal to said first provisional desired operating amount determined at said step (6).

4. A method as claimed in claim 1, 2 or 3, wherein, once the desired operating amount of said operation control means is determined in dependence on the detected value of said first engine operating parameter after it is determined that said engine has entered said predetermined low load condition, the operating amount of said operation control means is continuously or repeatedly controlled on the basis of the desired operating amount determined at said step (4) until said engine is determined to be in a condition other than said predetermined low load condition.

5. A method as claimed in claim 1, wherein said operation control means comprises fuel supply control means for controlling the quantity of fuel being supplied to said engine.

6. A method of electronically controlling the fuel supply to an internal combustion engine, wherein a required quantity of fuel is injected into said engine in synchronism with generation of pulses of a predetermined control signal indicative of predetermined crank angles of said engine, said engine having an intake pipe, a throttle valve arranged across said intake pipe, an auxiliary air passage opening in said intake pipe at a location downstream of said throttle valve and communicating with the atmosphere, and a control valve arranged in said auxiliary air passage for controlling the quantity of supplementary air being supplied to said engine through said auxiliary air passage and said intake pipe, said method comprising the steps of: (1) detecting a value of opening area corresponding to actual valve opening of said throttle valve; (2) detecting a value of opening area corresponding to actual valve opening of said control valve; (3) detecting an interval of time between generation of a preceding pulse of said predetermined control signal and generation of a present pulse of same; (4) detecting pressure in said intake pipe downstream of said throttle valve; (5) determining whether or not said engine is operating in a predetermined low load condition; (6) determining values of first and second coefficients, respectively, in dependence on the detected value of opening area of said throttle valve obtained at said step (1) and the detected value of opening area of said control valve obtained at said step (2), when said engine is determined to be operating in said predetermined low load condition; (7) determining a desired amount of fuel to be injected into said engine in dependence on a sum of the values of said first and second coefficients obtained at said step (6) and the detected value of interval of time between generation of a preceding pulse of said predetermined control signal and generation of a present pulse of same, obtained at said step (3); (8) determining the desired amount of fuel to be injected into said engine at least in dependence on the detected value of pressure in said intake pipe obtained at said step (4) when said engine is determined not to be operating in said predetermined low load condition; (9) determining a first provisional desired fuel injection amount in dependence on the sum of the values of said first and second coefficients corresponding, respectively, to the detected value of opening area of said throttle valve and the detected value of opening area of said control valve, as well as on the detected value of interval of time between generation of a preceding pulse of said predetermined control signal and generation of a present pulse of same, and a second provisional desired fuel injection amount at least in dependence on the detected value of pressure in said intake pipe, when it is determined that said engine has entered said predetermined low load condition from a condition other than said predetermined low load condition; (10) comparing the determined first provisional desired fuel injection amount with the determined second provisional desired fuel injection amount; (11) determining the desired fuel injection amount in dependence on the determined second provisional desired fuel injection amount from the time it is determined that said engine has entered said predetermined low load condition to the time the determined second provisional desired fuel injection amount becomes substantially equal to the determined first provisional desired fuel injection amount, even while said engine is actually operating in said predetermined low load condition; and (12) controlling the quantity of fuel to be injected into said engine on the basis of the desired fuel injection amount determined at said step (7), (8) or (11).

7. A method as claimed in claim 6, wherein, in said step (7), the desired fuel injection amount is determined in dependence on a product value obtained through multiplication of the sum of the determined values of said first and second coefficients by the detected value of interval of time between generation of a preceding pulse of said predetermined control signal and generation of a present pulse of same.

8. A method as claimed in claim 6, wherein said control valve comprises an on-off type electromagnetic valve, and an opening area value corresponding to actual valve opening of said control valve is determined in response to a valve opening duty ratio of said control valve.

9. A method as claimed in claim 6, 7 or 8, wherein said auxiliary air passage includes a plurality of passages, and said control valve includes a plurality of valves arranged in respective ones of said passages for controlling the quantity of supplementary air being supplied to said engine through corresponding ones of said passages and said intake pipe, said second coefficient having a value thereof determined in dependence on a total sum of values of opening areas corresponding to the respective valve openings of said plurality of valves.

10. A method as claimed in claim 9, wherein said second coefficient has a value thereof determined as a sum of coefficient values which are set in dependence on respective values of opening areas corresponding to actual valve openings of said plurality of valves.

11. A method as claimed in claim 6, wherein said step (5) comprises the steps of detecting a value of pressure in said intake pipe upstream of said throttle valve, setting a reference pressure value in dependence on the detected value of pressure in said intake pipe upstream of said throttle valve, comparing said reference pressure value with the detected value of pressure in said intake pipe downstream of said throttle valve, obtained at said step (4), and determining that said engine is operating in said predetermined low load condition when the detected value of pressure in said intake pipe downstream of said throttle valve shows a value indicative of lower engine load with respect to said reference pressure value.

* * * * *